United States Patent [19]

Davis

[11] 3,943,028

[45] Mar. 9, 1976

[54] APPARATUS AND PROCESS FOR MANUFACTURING NON-WOVEN TEXTILE PILE

[76] Inventor: Donald MacKinnon Davis, 616 E. Brow St., Lookout Mountain, Tenn. 37350

[22] Filed: June 3, 1974

[21] Appl. No.: 475,925

[52] U.S. Cl. ..... 156/435; 156/498; 156/515

[51] Int. Cl.[2] ..... D04H 11/08

[58] Field of Search ..... 156/72, 180, 181, 251, 156/254, 282, 296, 435, 498, 515; 83/171, 16

[56] References Cited

UNITED STATES PATENTS

| | | | |
|---|---|---|---|
| 2,160,154 | 5/1939 | Kellog et al. | 156/435 |
| 2,438,156 | 3/1948 | Dodge | 156/251 |
| 2,526,649 | 10/1950 | Gaibel | 156/251 |
| 3,333,494 | 8/1967 | Smith | 83/171 |
| 3,359,147 | 12/1967 | Miller | 156/72 |
| 3,840,414 | 10/1974 | Gidge et al. | 156/72 |
| 3,847,692 | 11/1974 | Bondi | 156/72 |

*Primary Examiner*—William A. Powell
*Assistant Examiner*—Michael W. Ball
*Attorney, Agent, or Firm*—Parrott, Bell, Seltzer, Park & Gibson

[57] ABSTRACT

Apparatus and process for manufacturing non-woven textile pile fabric from a plurality of pile-forming strands having thermoplastic characteristics, as follows. A hollow strand extruder receives parallel textile strands therein extending longitudinally therethrough and shapes the strands into a continuous mass of a predetermined configuration for withdrawal therefrom. A plurality of relatively thin spaced-apart successive compartment devices are positioned generally in axial alignment with the extruder and define successive spaced-apart open-sided interior areas of the same general configuration of the shaped mass of strands and collectively define a longitudinally-extending passageway for receiving and holding the continuous mass of strands therein after withdrawal from the extruder. Mechanisms, preferably electrically heated hot wires, are mounted for progressive movement transversely of the strands through the spaces between and on each side of the compartments for transversely melting, cutting and fusing the mass of strands into a plurality of individual, transversely-extending slices of the shaped predetermined configuration and having fusedfiber outer faces with strands extending therebetween which maintain the integrity of the slices for subsequent cutting between the fused faces to form layers of non-woven pile fabric.

19 Claims, 32 Drawing Figures

10
69
68
67
58
51
52
56
14
12
13
16
16
5
5
59
66
42
70
35
41
38
40
39
59
27
50
47
59
54
25
20
23
21
28
25
23
26

APPARATUS AND PROCESS FOR MANUFACTURING NON-WOVEN TEXTILE PILE

BACKGROUND OF THE INVENTION

This invention relates to combinations and subcombinations of apparatus and processes for manufacturing non-woven textile pile fabric from a plurality of pile forming strands having thermoplastic characteristics by fabricating, from a continuous mass of longitudinally-extending strands, slices of such strands of predetermined configuration having interconnected fused-fiber outer faces with strands extending therebetween which maintain the integrity of the slices for subsequent cutting between the fused faces to form layers of non-woven pile fabric.

Textile pile fabrics, as primarily utilized for carpeting but which also may be utilized as linings, insulation, wall tile, furniture upholstery, etc., were originally manufactured by hand weaving, which was replaced by mechanized looms, and which in turn were replaced during the last 30 years by tufting machines. Tufting has by far been the primary manufacturing operation for producing such pile fabrics. However, while tufting continues to be utilized wide spread for producing pile fabrics, it is being replaced more and more in recent times by a non-woven process known in the trade as "bonding".

Basically, bonding is implanting yarns or fiber batts in cut pile or loop configuration on an adhesive coated backing material. These bonding processes eliminate many of the expensive manufacturing operations involved in tufting. There are numerous techniques or systems for bonding and many patents have issued which pertain thereto. Of these systems, probably the most well known include what is known in the trade as "the single end implantation systems" and "the multiple fold implantation systems." The single end implantation systems refers to a single cut of yard being implanted on an adhesive coated backing. The multiple fold implantation systems generally relate to the folding or pleating of continuous yarns or webs of fibers onto an adhesive coated backing to form loops of the yarns or webs of fibers which may either be utilized as loop pile fabrics or may be cut to form cut pile fabrics. These multiple fold implantation systems also include pleating or folding of yarns or webs back and forth between two adhesive coated backings and then cutting between the backings to form two layers of non-woven pile fabric.

Other bonding systems of implanting yarns or fiber batts in cut pile or loop pile configuration on an adhesive coated backing have been suggested, such as the "thermo weave freeze system" which basically involves drawing yarn from a creel in a specified sequence according to a desired pattern, compacting the yarn, moistening the yarn, freezing the yarn together, and cutting the frozen yarn into tiles by circular saws. Also, it has been suggested to cut and fuse such compacted yarn by heated blades or wires to form cut and fused slices or tiles. The tiles of both of these systems purportedly can be used as standard carpet tiles or combined to form a patterned non-woven pile carpet. However, neither of these systems, particularly the cut-fuse system, have been commercially satisfactory due to the lack of adequately designed processes and apparatuses for forming such tiles. Numerous other systems have also been suggested.

While all of these bonding systems offer advantages over conventional tufting systems for producing textile pile fabric, such as greater utilization of yarn because no yarn is on the rear of the backing material, greater density, less delamination problems, higher machine efficiency, allowing the use of second quality yarns, elimination of "rowing" characteristics, allowing the use of single yarns rather than twisted yarns, etc., there are still presented certain problems with these bonding techniques which have deterred their commercial acceptability and use in the trade. These problems include the necessity in many instances of the use of yarns rather than fibers or strands which involves expensive textile yarn making operations, lack of development of fabricating machines and process steps which provide consistency in manufacturing operations with the requisite speed for economical manufacturing operations and high quality end products, etc.

SUMMARY OF THE INVENTION

Accordingly, it is the object of this invention to provide apparatus and processes which may be utilized in the manufacture of nonwoven textile pile fabric from a plurality of pile forming strands having thermoplastic characteristics and which overcomes the above mentioned problems with prior non-woven pile fabric manufacturing techniques and which produces an economical and inexpensive end product of high quality and which allows the use of rovings or tow eliminating the necessity of textile yarn manufacturing operations.

It has been found by this invention that the above objects may be accomplished in its broadest aspect, as follows.

A process is provided for fabricating a plurality of individual slices of textile, pile-forming strands having interconnected, fusedfiber outer faces with strands extending therebetween for subsequent cutting between the fused faces to form layers of non-woven pile fabric which may have bonding backings adhered thereto including the steps of receiving and shaping a plurality of parallel textile strands having thermoplastic characteristics into a continuous longitudinally-extending mass of generally parallel, longitudinally-extending strands of a predetermined transverse cross-sectional configuration, positioning and holding the shaped continuous mass of strands at spaced-apart locations around the circumference thereof to maintain the shaped configuration, and simultaneously transversely melting, cutting and fusing the continuous shaped mass of longitudinally-extending strands on each side of and between the spaced-apart locations at which the mass is being held into a plurality of slices of the shaped predetermined configuration having fused-fiber outer faces with strands extending therebetween for maintaining the integrity of the slices.

An apparatus is provided which includes hollow strand extruder means for receiving therein parallel strands extending longitudinally therethrough and for shaping the strands into a continuous mass of a predetermined configuration for withdrawal from the extruder means. A plurality of relatively thin, spaced-apart, successive, compartment means are positioned generally in axial alignment with the extruder means and define successive, spaced-apart, open sided, interior areas of the same general configuration as the shaped mass of strands and collectively define a longitudinally-extending passageway for receiving and holding the continuous mass of strands therein after withdrawal of the extruder means. Means, preferably electrically heated hot wires, are mounted for progressive movement transversely of the strands through the spaces between and on each side of the compartment means for transversely melting, cutting and fusing the mass of strands into a plurality of individual, transversely-extending slices of the shaped predetermined configuration having interconnected, fused-fiber, outer faces with strands extending therebetween which maintain the integrity of the slices for subsequent cutting between the fused faces to form layers of non-woven pile fabric which may have adhesively bonded backing secured thereto.

With the above stated apparatus and process in accordance with this invention, slices or tiles are formed having strands extending between fused-fiber outer faces thereof which slices or tiles may be cut between the fused faces to form tiles or slices of non-woven pile fabric. These tiles or slices of non-woven pile fabric may include adhesively bonded backing thereon to be used as individual tiles or slices of pile fabric in any desired manner or the tiles or slices may be commonly mounted on a backing to form patterned pile carpets or other materials. A wide variety of uses of the non-woven tiles or slices produced in accordance with this invention will be apparent.

Other specific and alternative features of the processes and apparatus of this invention will be set forth in the detailed description to follow.

BRIEF DESCRIPTION OF THE DRAWINGS

Some of the objects and advantages of this invention having been stated, other objects and advantages will appear as the description proceeds, when taken in conjunction with the accompanying drawings, in which:

FIG. 3 is an enlarged, perspective view of the slice forming apparatus utilized in the apparatus of FIG. 1;

DETAILED DESCRIPTION OF THE INVENTION

Figures 1, 2A, 2B, 2C, 2D:
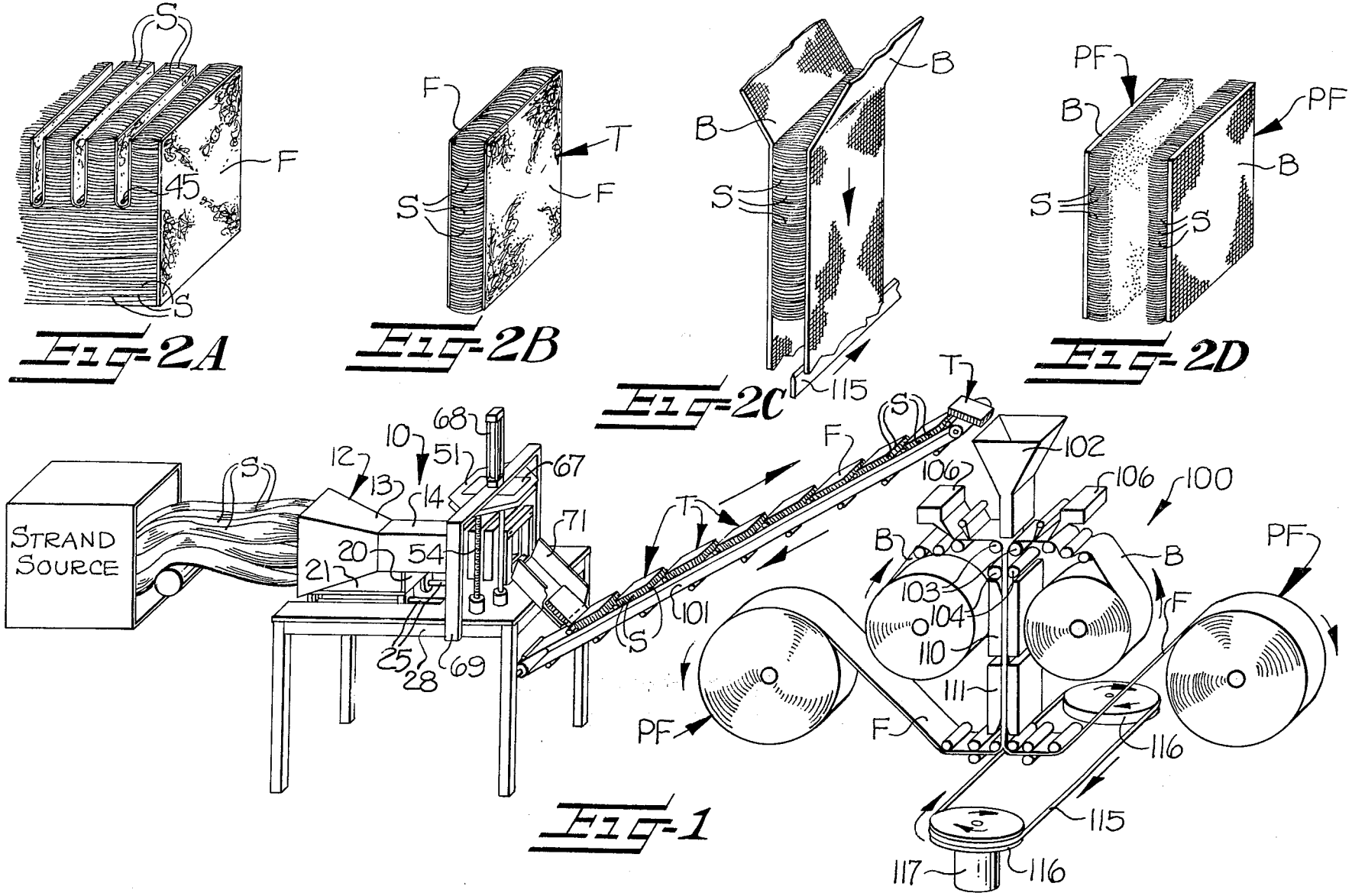
FIG. 1 is a schematic, perspective view of an apparatus for manufacturing textile pile fabric in accordance with this invention.
FIGS. 2A, 2B, 2C and 2D are schematic, perspective views illustrating certain process steps in accordance with this invention.
Figure 5:
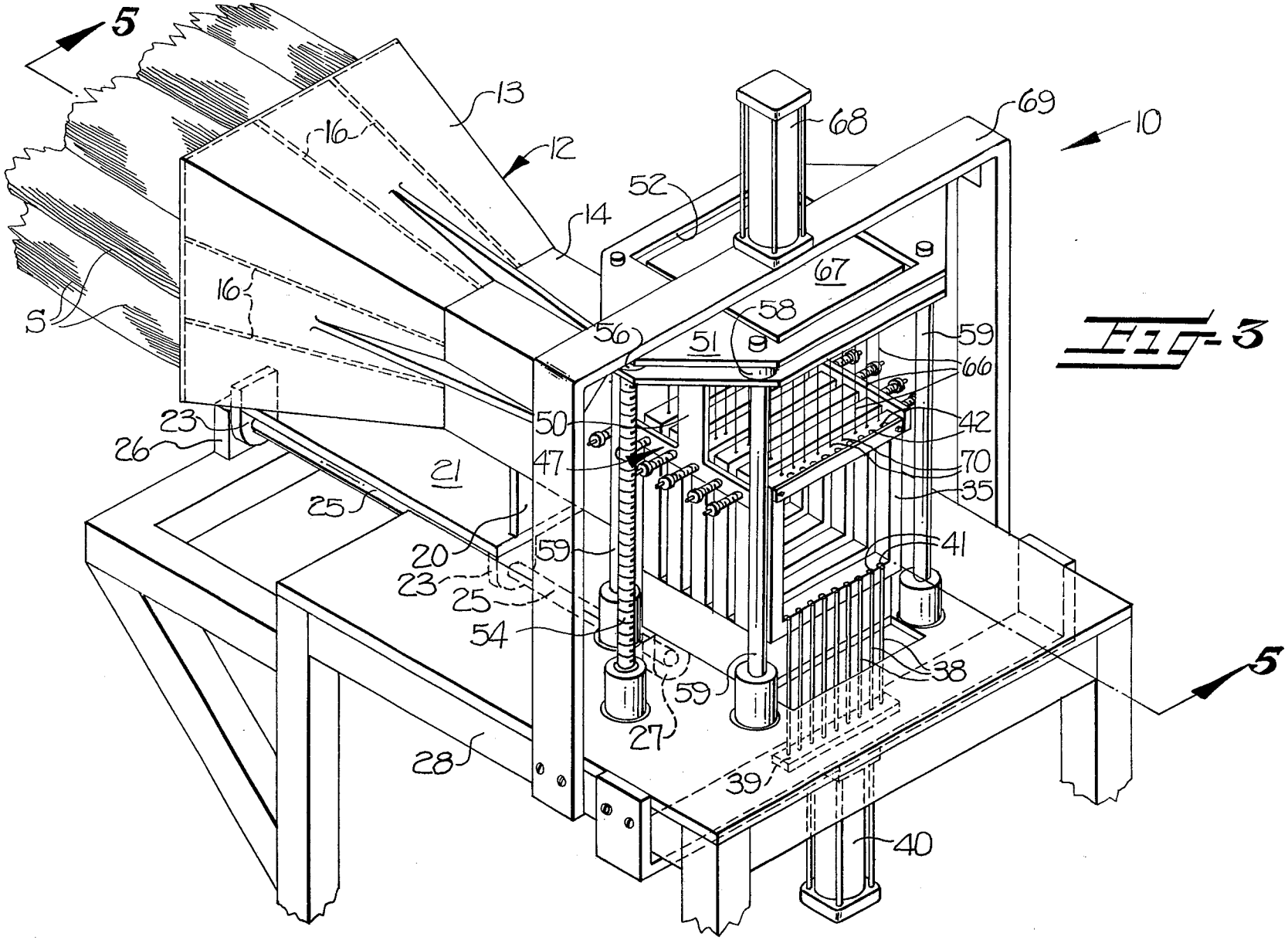
FIG. 5 is a longitudinal cross-sectional view, taken generally along the line 5—5 of FIG. 3, illustrating the devices thereof in position for beginning the slice forming manufacturing process of this invention.

Referring now to the drawings, the apparatus and process of this invention are for the manufacture of non-woven, textile pile fabric PF from a plurality of pile forming strands S having thermoplastic characteristics including the manufacture of slices or tiles T of predetermined shaped configuration having interconnected fused fiber outer faces F with strands S extending therebetween for maintaining the integrity of the slices or tiles T for subsequent cutting between the fused faces F to form layers of non-woven pile fabric PF which may include adhesively bonded backings B secured thereto. FIGS. 2A–2D schematically illustrate this sequence of manufacturing operations.

The strands S may be any suitable continuous filament, cut filament or fibers in the form of rovings, tow or yarns, etc., and the term "strands" as used herein is intended to cover all of these. The strands S have thermoplastic characteristics and may be entirely thermoplastic strands or a blend of thermoplastic and non-thermoplastic having sufficient thermoplastic characteristics to be melted, cut and fused when subjected to heat by electrically heated hot wires or other devices. Nylon, polypropolene and polyester have been found to be particularly satisfactory.

Referring now to FIG. 1, a suitable overall apparatus for the manufacturing of the non-woven textile pile fabric PF is illustrated therein. Basically, this apparatus includes a source of generally parallel strands S which is illustrated only schematically in FIG. 1 and labled as such. As mentioned above, these strands S may be in the form of rovings or tow and, thus, eliminate the necessity of expensive textile yarn forming operations. The generally parallel textile strands S are fed to a slice or tile forming apparatus, generally indicated in FIG. 1 by the reference numeral 10, which is specifically designed for receiving and shaping the plurality of parallel textile strands S into a continuous longitudinally-extending mass of generally parallel longitudinally-extending strands of a predetermined transverse cross-sectional configuration, positioning and holding the shaped continuous mass of strands at spaced-apart locations around the circumference thereof to maintain the shaped configuration, and simultaneously transversely melting, cutting and fusing the continuous shaped mass of longitudinally-extending strands on each side of and between the spaced-apart locations at which the mass is being held into a plurality of slices or tiles T of the predetermined configuration having fused-fiber outer faces F with strands S extending therebetween for maintaining the integrity of the slices or tiles T.

The apparatus 10 may receive groups of parallel strands S of different characteristics or color and arrange these strands S of different characteristics into a predetermined pattern in the shaped mass of strands. Preferably, the continuous mass of strands formed extends in a horizontal direction and the melting, cutting and fusing is performed in a vertical direction from the top of the mass of strands to the bottom of the mass of strands. Further details and construction of the slice or tile forming apparatus 10 will be given below.

From the slice or tile forming apparatus 10, the individual slices or tiles T may be received by any convenient mechanism which may secure or adhesively bond a backing B to the individual tiles on each fused-fiber face F thereof and subsequently mechanically cut the tiles or slices T between the fused-fiber faces to form layers of non-woven textile pile fabric PF. A suitable embodiment of such a mechanism for applying adhesive bonding backings and mechanically cutting the tiles between the fused faces thereof is schematically illustrated in FIG. 1 and generally referred to by the reference numeral 100. Further details and construction of this apparatus 100 will be discussed below.

Referring now in more detail to the slice or tile forming apparatus 10 reference is made specifically to FIGS. 3–12. This apparatus 10 includes a strand extruder device 12 comprising an elongate, hollow, generally funnel-shaped, preferably horizontally-extending housing having an outwardly tapering rear portion 13 for receiving therein parallel textile strands S which extend longitudinally through the housing, and a forward portion 14 of less cross-sectional dimensions than the rear portion 13 and of a predetermined cross-sectional shape for compressing and shaping the strands S into a continuous mass of the predetermined configuration of the forward portion 14 for withdrawal from the extruder means 12. As shown particularly in FIGS. 4, 5 and 7, the forward portion 14 of the extruder 12 is of generally square cross-sectional configuration for compressing and shaping the parallel strands S into a continuous, generally square, cross-sectional mass.

Figures 4, 5, 6, 7:
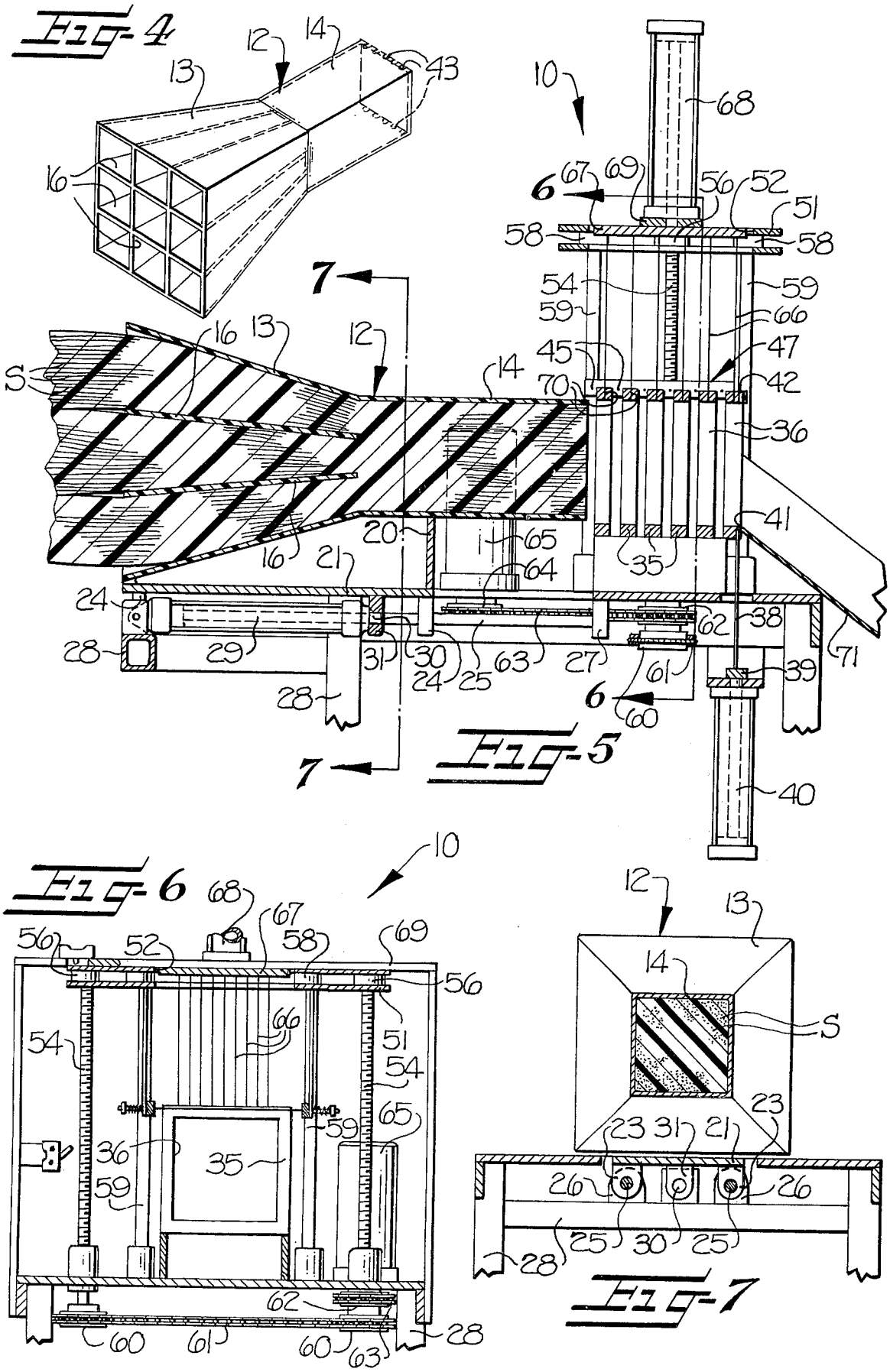
FIG. 4 is a reduced, perspective view of the strand extruder mechanism utilized in the apparatus of FIG. 3.
FIG. 6 is a cross-sectional view, taken generally along the line 6—6 of FIG. 5.
FIG. 7 is a cross-sectional view, taken generally along the line 7—7 of FIG. 5.

The rear portion 13 of the extruder may include a plurality of longitudinally and transversely extending baffles 16 therein separating the hollow interior of the rear portion into longitudinally-extending compartments for receiving strands S of different characteristics or colors in different compartments. As illustrated in FIG. 4, the baffles 16 are in a checkerboard configuration to divide the interior of the rear portion 13 of the extruder 12 into separate, generally square, cross-sectional configuration, individual compartments which may receive groups of parallel strands S of different colors or other different characteristics therein for forming a predetermined pattern, to be discussed more fully below.

The extruder 12 is mounted for reciprocating axial, longitudinal movement by means of a piston and cylinder operated carriage mechanism. This carriage mechanism includes an extruder support consisting of a downwardly extending flange member 20 secured to the front portion 14 of the extruder 12 at one end and at the other end to a horizontally extending plate member 21 which is in turn secured at its rear end to the rear portion 13 of the extruder member 12. Secured to and depending downwardly from each side of the plate member 21 are slide members 23 and 24 having central apertures therein for being mounted on slide rods 25 which extend longitudinally of the extruder 12 on each side thereof. The slide rods 25 are supported by collars 26 at their rear end and collars 27 at their forward end. The collars 26 and 27 carried by a suitable machine frame, collectively indicated by the reference numeral 28, which may be of any convenient form for supporting the entire slice forming mechanism 10 from the floor of the room in which it is positioned. Thus, the extruder 12 is supported for sliding, reciprocation, back and forth movement along the slide rods 25.

For driving the extruder device 12 in this reciprocating movement, there is provided a hydraulic or pneumatic piston-cylinder device 29 supported by the frame 28 and having an outwardly extending piston rod 30 secured at its forward end to a downwardly extending flange member 31 from the plate 21 of the extruder carriage. As fluid is introduced into one end of the piston-cylinder device 29, the piston rod 30 will be moved forwardly to move the extruder carriage and extruder 12 forwardly until the flange 31 comes in contact with the collar 27 to stop the forward reciprocating movement of the extruder 12 (see position of FIG. 8). Fluid may then be introduced into the other end of the piston-cylinder device 29 to retract the piston rod 30 and thus move the extruder 12 back to its original position (see FIG. 9). This reciprocating action of the extruder 12 is for the purpose of withdrawing the compacted mass of strands S from the extruder 12 in a manner to be described below.

The slice or tile forming apparatus 10 further includes a plurality of relatively thin, spaced-apart, successive, compartment devices 35 positioned generally in successive axial alignment with the extruder 12 and defining successive, spaced-apart, open-sided, interior areas 36 of the same general configuration as the shaped mass of strands S and collectively defining a longitudinally-extending, generally horizontal internal passageway for receiving and holding the continuous mass of strands therein after withdrawal from the extruder 12. As may be seen in FIGS. 3, 5, 6 and 8–12, these compartment devices 35 are generally of square cross-sectional configuration and may be defined as being generally window-shaped to form interior areas of generally square cross-sectional configuration just slightly larger than the outside cross-sectional dimensions of the forward portion 14 of the extruder 12 for receiving the forward portion 14 of the extruder 12 therein, as shown in FIG. 8.

Figure 8:
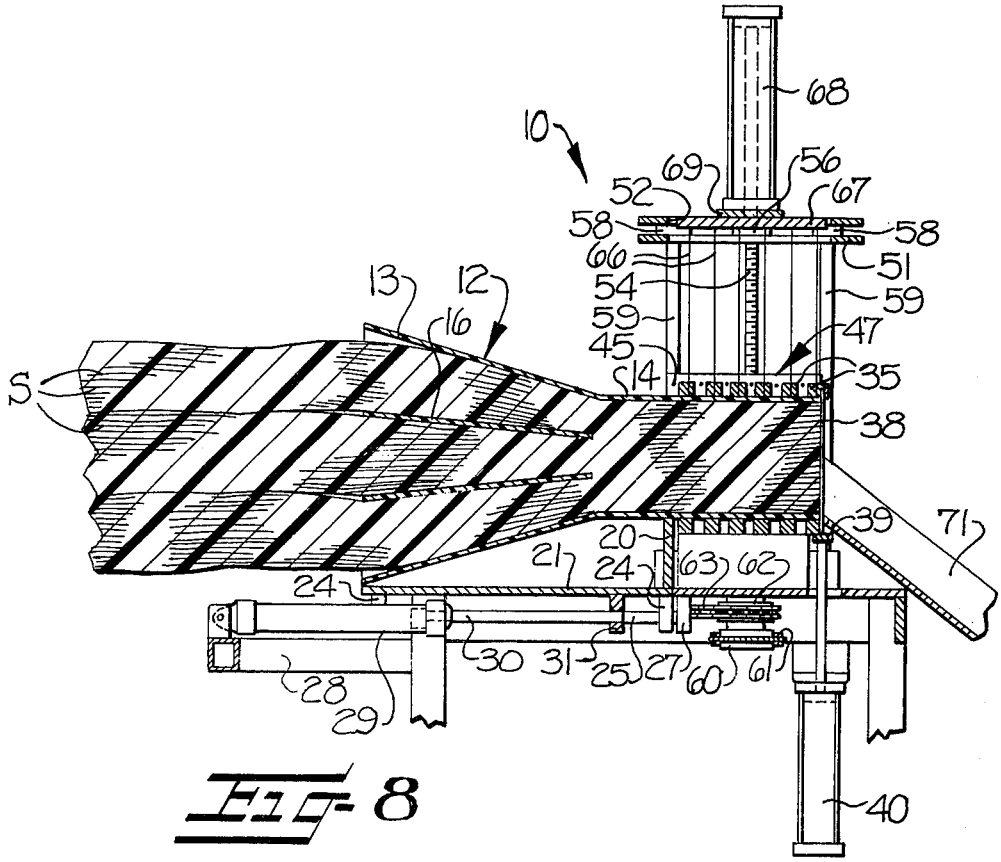
FIGS. 8, 9, 10, 11 and 12 are cross-sectional views, like FIG. 5, illustrating the devices of the apparatus in their successive positions during the slice forming manufacturing operation of this invention.

For loading these compartment devices 35, the extruder 12 is reciprocated in its forward stroke into and through the passageway formed by the interior areas 36 of the compartment devices 35 to the forward position thereof, as shown in FIG. 8. Cooperating with the extruder 12 in this forward position are means positioned adjacent the forward end of the compartment devices 35 for engaging the forward end of the shaped mass of strands within the extruder 12 when the extruder reaches this forward end of the compartment devices 35 for holding the continuous shaped mass of strands within the interior areas 36 of the compartment devices 35 during the rearward reciprocating movement of the extruder means.

Figure 9:
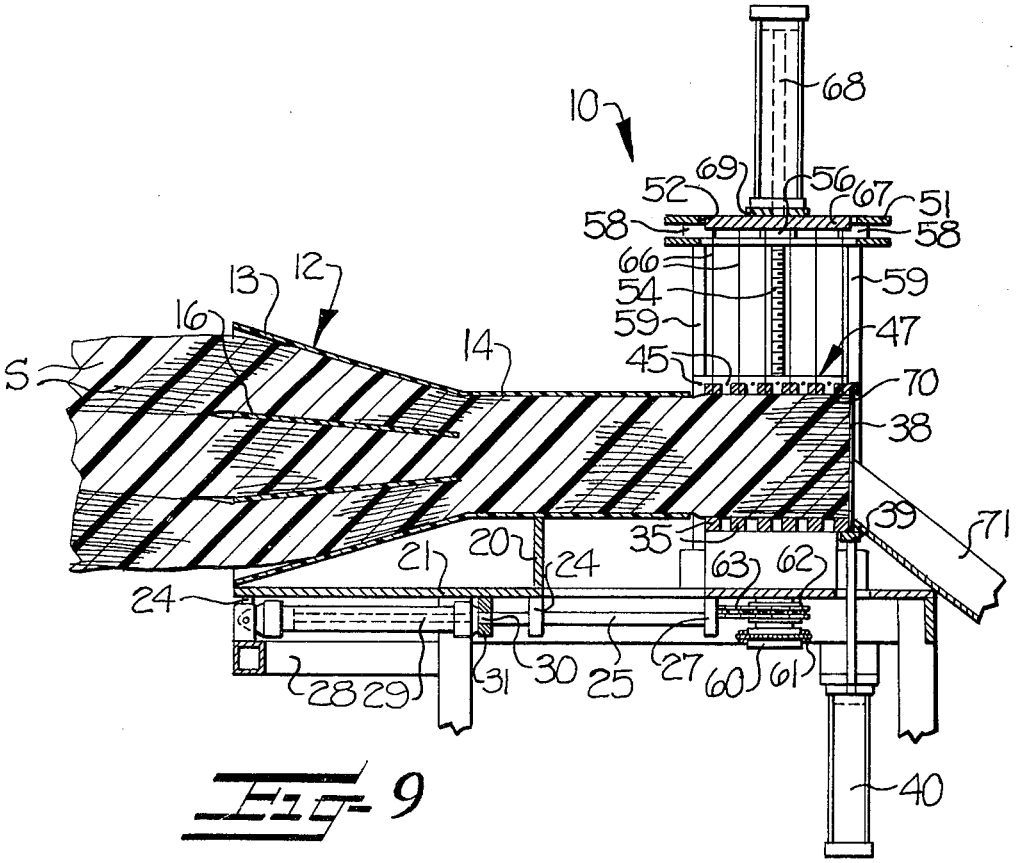
Figure 10:
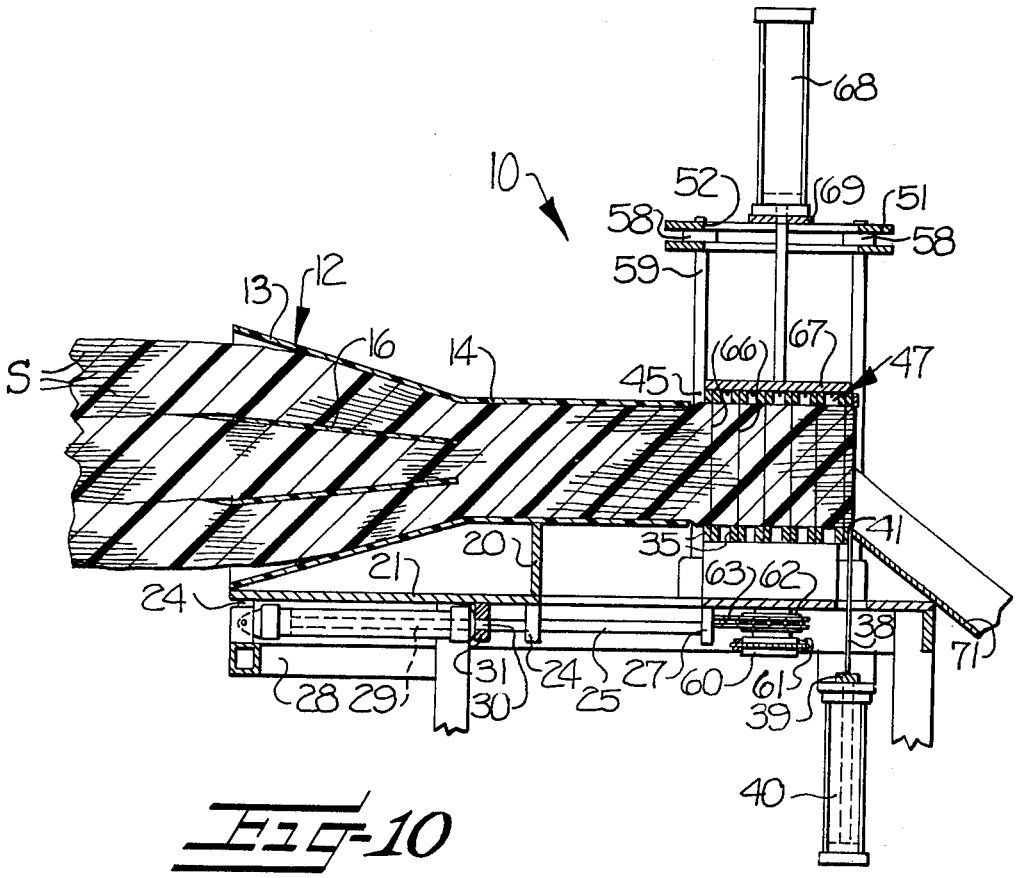

Preferably, this holding means comprises a plurality of needles 38 commonly mounted at their lower ends on a block 39 and extending upwardly therefrom. The block 39 is carried on one end of a piston rod of a piston-cylinder device 40 which is suitably carried by the machine frame 28. The piston-cylinder 40 may be pneumatically or hydraulically operated to reciprocate the needles 38 in an up and down reciprocating path of travel. The needles 38 pass through cut outs or notches 41 in the bottom forward face of the forwardmost compartment device 35 and through slots or apertures 42 in the top forward face of the forwardmost compartment device 35. The forward end of the extruder 12 also has similar mating notches 43 in its forward end thereof so that when the extruder device 12 has reciprocated to its forwardmost position in alignment with the forward face of the forwardmost extruder device 35, the needles 38 may be reciprocated upwardly, from the position shown in FIGS. 3 and 5, to the position shown in FIG. 8 such that the needles pass through the notches 41, slots 42 and notches 43 and penetrate the mass of strands S contained within the extruder 12. Inasmuch as the previous slice forming operation has formed a fused fiber face on the front of the mass of strands S within the extruder 12, in a manner to be described below, the needles 41 will be positioned inside of the fused front face of the mass of strands S in the extruder 12 and will stay in this position while the extruder 12 is being reciprocated to its rearward portion, as shown in FIGS. 8 and 9.

The holding action of the needles 38 on the inside of the fused front face of the mass of strands, will allow the extruder 12 to slide back over the mass of strands S within the compartment devices 35 and thus load the compartment devices 35 for the next slice forming operation.

The above arrangement of holding needles 38, notches 41 and slots 42 on the forwardmost compartment device 35 and the mating notches 43 on the forward end of the extruder 12 is generally designed for use when manufacturing relatively small slices or tiles T of approximately 6 by 6 inches by 1 inch. However, when larger tiles or slices T are manufactured, e.g. generally 18 inches by 18 inches by 1 inch or larger, a different arrangement of holding needles would probably be required. This alternate arrangement (not illustrated) could include two sets of needles mounted for reciprocation by suitable piston-cylinder devices to penetrate the mass of strands S from two sides thereof and for extending to generally the middle of the mass of strands. If a support is needed at the center of the mass of strands for the two sets of needles, an electromagnet could be provided that moves into place against the fused face at the front of the mass of strands for supporting the needles during the retracting movement of the extruder.

With the compartment devices 35 now loaded with the mass of strands S of the shaped predetermined configuration and being held within the compartment devices 35 at spaced-apart locations by the compartment devices 35, the cutting and fusing operation may now be performed.

For this purpose, a pluality of spaced-apart, horizontally-extending electrically heated, hot wires 45 are commonly mounted on a movable frame 47. The hot wires 45 extend horizontally across the mass of strands S and are positioned on the frame 47 over each of the spaces between and on each side of the compartment devices 35 for progressive vertically downward movement from the top of to the bottom of the mass of strands S through the spaces between and on each side of the compartment devices 35 for transversely melting, cutting and fusing the mass of strands S into a plurality of individual, transversely-extending slices or tiles T of the shaped predetermined configuration (see schematic illustration of FIG. 2A) having interconnected, fused-fiber, outer faces F with strands S extending therebetween which maintain the integrity of the slices (see schematic illustration of FIG. 2B).

The electrically heated hot wires 45 may be suitably connected (not shown) to any source of electrical energy for heating the hot wires 45 in a manner well understood by those with ordinary skill in the art. The frame 47 generally comprises a downwardly extending, inverted, T-shaped support plate 50 on each longitudinal side of the compartment devices 35 for mounting the hot wire 45 therebetween. The upper end of the inverted T-shaped plates 50 are carried by a horizontally-extending double plate member 51 which includes a central cut-out portion 52 for purposes to be described below. The horizontally-extending double plate member 51 is supported on each outer end thereof by screw shafts or worms 54 which pass through mating threaded collars or nut members 56 carried between the double plate member 51. The frame portion 47 may also be supported at other locations thereon by sliding collars 58 which receive upstanding slide rods 59 carried by the machine frame 24 so that the hot wire frame 47 will slide up and down the slide rods 59 and be supported against horizontal displacement by the slide rods.

Figure 11:
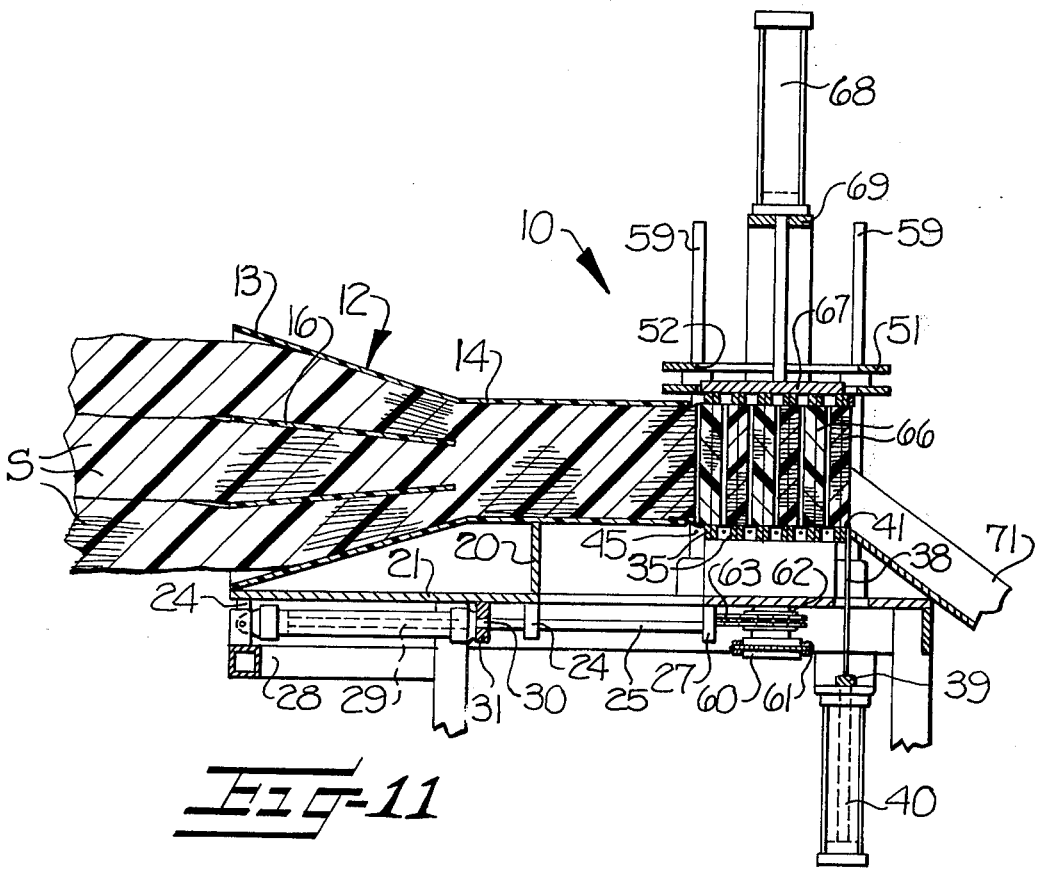

The bottom ends of the worms or screw shafts 54 carry sprocket gears 60 (see FIG. 5) which are interconnected by a chain 61 therearound. One of the worms 54 also carries a sprocket 62 which receives a chain 63 which also passes around a sprocket 64 on the drive shaft of a reversible motor 65. Rotation of the motor 65 in one direction will rotate the worms 54 to cause the hot wire supporting frame 47 to move downwardly which progressively moves the hot wires 45 downwardly between the spaces and on each side of the compartment devices 35 for cutting, melting and fusing the mass of strands S therein into a plurality of slices or tiles T within the compartments 35 (as shown in FIG. 11). When the hot wires 45 reach the bottom of the compartments 35, the motor 65 will be reversed to move the hot wires 45 upward and out of the spaces between the compartments 35 for the next slice forming operation.

As schematically illustrated in FIG. 2A, the hot wires 45 will cause a melting action of the strands S as they are progressively moved downwardly due to the thermoplastic characteristics of the strands S and will cause the strands S to fuse with each other at their outer melted ends forming a fused fiber face F on each of the slices or tiles T being formed.

Although electrically heated hot wires are the preferred means for melting, cutting and fusing utilized in the tile forming apparatus 10 of this invention, other devices, such as laser beams, could be utilized for providing sufficient heat to melt, cut and fuse the mass of strands S into individual slices or tiles T.

If desired and particularly when fabricating relatively large slices or tiles T, means may be provided for providing support and holding the mass of strands S in each of the compartment devices 35 during the melting, cutting and fusing operation. For this purpose, a plurality of rows of spaced-apart needles 66 may be commonly mounted on a plate 67 which is carried on the end of a piston rod from a piston-cylinder device 68 positioned in the cut-out 52 and mounted on an inverted U-shaped support frame 69 carried by the main machine frame 28. The piston-cylinder device 68 may be pneumatically or hydraulically operated to reciprocate the plate 67 and needles 66 down and up in a vertical reciprocating movement. The needles 66 are positioned for passage through a plurality of apertures 70 in the upper portion of each of the compartment devices 35, so that, on the downward stroke, the holding needles 66 will pass through the apertures 70 and into the interior areas 36 of each of the compartment devices 35 for engaging the mass of strands S therein and holding the mass of strands S (see FIGS. 10 and 11) during the melting, cutting and fusing operation of the hot wires 45 to prevent distortion of the slices of tiles T within the compartment devices 35 during the slice forming operation. When the slice forming operation has been completed, the needles 66 will be retracted by the piston-cylinder device 68 out of the interior areas 36 of the compartment device 35 for doffing or removal of the thus formed slices or tiles T therefrom.

Figure 12:
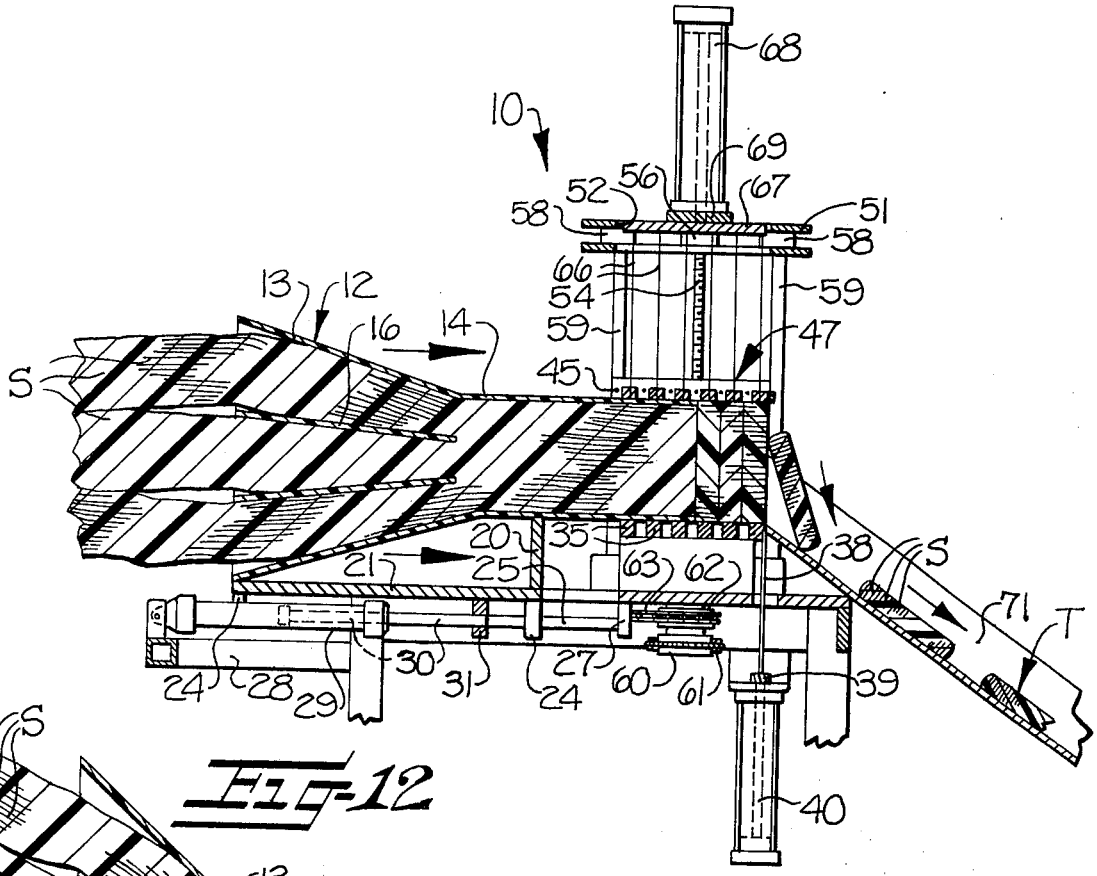

For removing or doffing the slices or tiles T from the interior areas 36 of the compartment devices 35, the extruder device 12 performs this operation. As shown in FIG. 12, during the forward reciprocating movement of the extruder device 12 for reloading of the compartment devices 35 after a previous slice forming operation, the previously formed slices or tiles T will be pushed out of the interior areas 36 of the compartment devices 35 by this forward reciprocating movement of the extruder device 12 to be received on and passed down a receiving chute 71. As will be appreciated, the forward end of the mass of strands S in the extruder device 12 will have a fused-fiber front face due to the previous slice forming operation in which one of the hot wires 45 separated the mass of strands S within the compartment devices from the mass of strands S in the extruder 12 (see FIG. 11).

For completing the formation of non-woven pile fabric PF from the thus formed slices or tiles T, the slices or tiles T may be received on a moving conveyor 101 (see FIG. 1) and passed upwardly to be expelled into a chute 102 of the pile fabric forming apparatus 100. From the chute 102, the slices or tiles T are received between opposed pairs of driven feed rolls 103 and 104 to move downwardly in a generally vertical direction. The feed rolls 103 and 104 also receive two continuous sheets of backing material B which pass from suitable supply rolls 105 around a series of guide rolls and past adhesive applicator mechanisms 106 which applies adhesive to the outer faces of the sheets of backing material B. The sheets of backing material B with the adhesive coated faces then pass around driven feed rolls 103 and 104 such that the individual tiles T are received between the adhesive coated faces of the backing material B and the backing material B is adhesively secured to each of the fused faces F of the slices or tiles T. The slices or tiles T and the backing material B are then passed through a heating device 110 and a cooling device 111 which completes the bond of the backing material to each of the fused faces F of the tiles T. The thus formed material then passes into engagement with a continuous band saw 115 which is rotated by pulley mechanisms 116 through motor 117 to cut the strands S extending between the fused faces F and separate the material into two sheets of non-woven pile fabric PF for being rolled up or otherwise taken off of the apparatus 100. The thus cut pile fabric PF may again be suitably cut into individual slices or tiles T having backing B thereon and upstanding pile strands for use in any desired manner.

The above-described pile fabric fabricating mechanism 100 is only schematically illustrated in the drawings and the illustration given therein is believed to be sufficient for an understanding of the present invention which resides primarily in the processes and apparatus disclosed for fabric fabricating of the slices or tiles T. Many other variations of pile forming apparatus may be utilized in conjunction with the slice or tile forming apparatus 10 of this invention.

Figure 13:
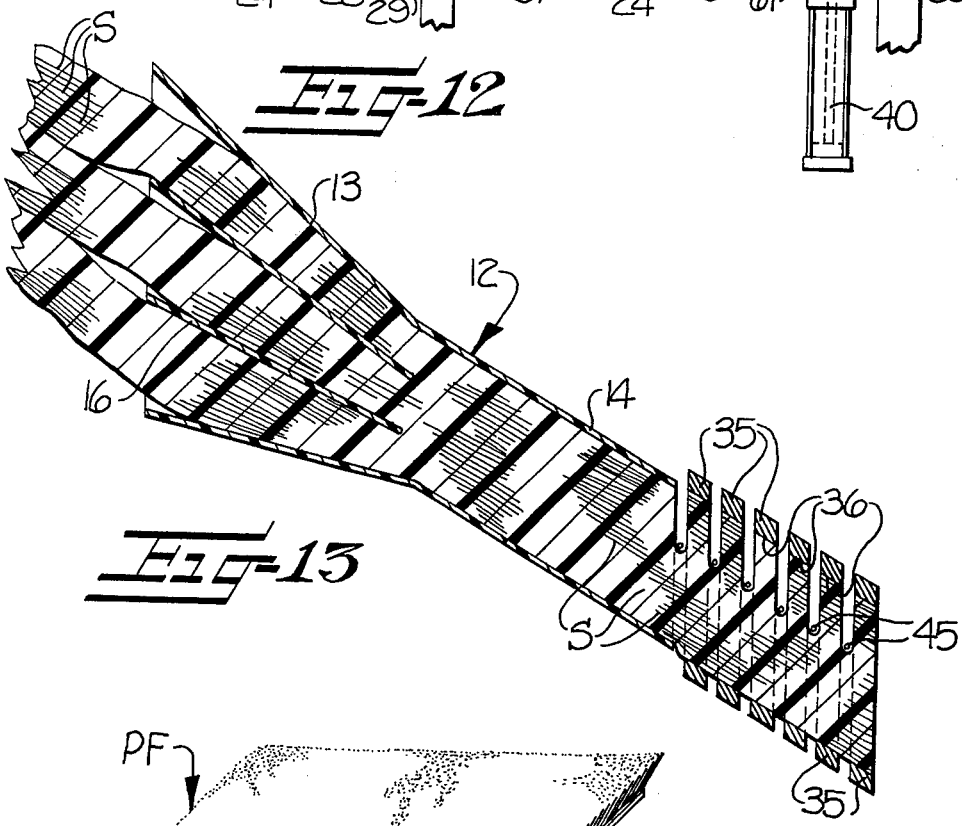
FIG. 13 is a cross-sectional view of an alternate arrangement of a strand extruder device and holding compartment devices which may be utilized in the slice forming apparatus of FIGS. 3–12.
Figure 14:
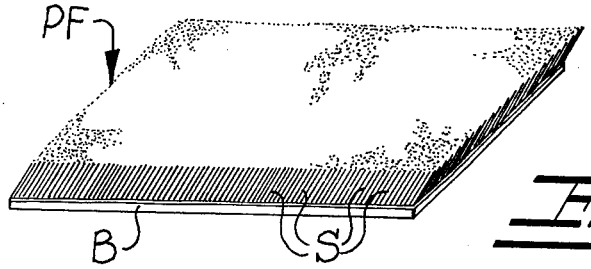
FIG. 14 is a perspective view of a resulting non-woven pile fabric slice which is formed by utilizing the apparatus of FIG. 13.

Referring now to some of the alternative features which may be utilized in the slice or tile forming apparatus 10 of this invention and first with reference to FIGS. 13 and 14, it is sometimes desired and advantageous to form a non-woven pile fabric PF having pile strands S extending therefrom at an angle with respect to the vertical and having a directional lay therein, as shown in FIG. 14. For this purpose, the compartment devices 35 are successively arranged at an acute angle with respect to the horizontal and the passageway defined by the interior areas 36 thereof is also disposed generally at an acute angle with respect to the horizontal. The spaces between the compartment devices 35 extend generally vertically so that the hot wires 45 may pass vertically between the compartment devices 35 (as shown in FIG. 13) for forming slices or tiles T having interconnected fused-fiber faces with strands extending therebetween at an angle for subsequent cutting between the fused-fiber faces to form layers of non-woven pile fabric, PF (as shown in FIG. 14) with the pile strands thereof having a directional lay and extending at an angle to the vertical.

Figure 15:
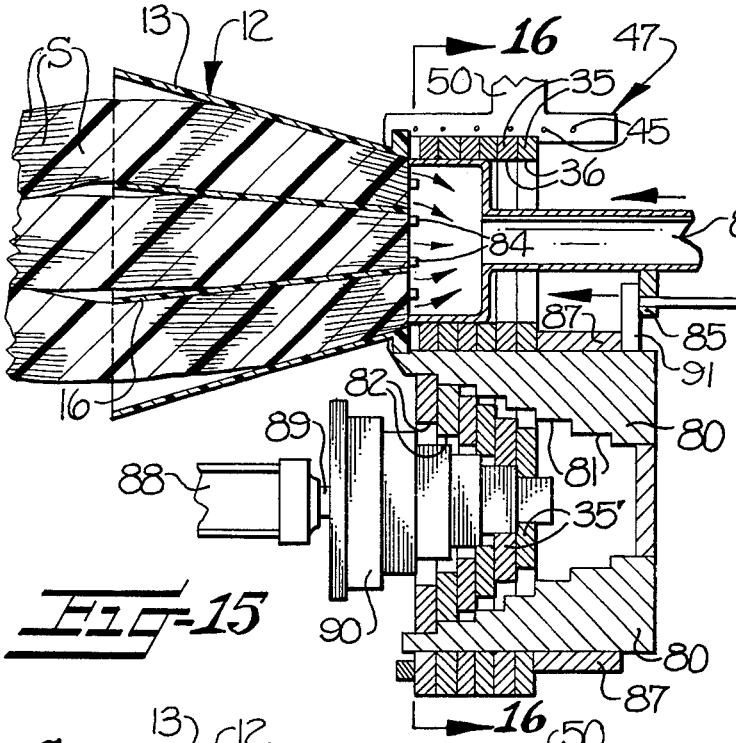
FIG. 15 is a cross-sectional view of an alternate form of extruder device, holding compartment devices and vacuum loading mechanism which may be utilized in the slice forming apparatus of this invention.
Figure 16:
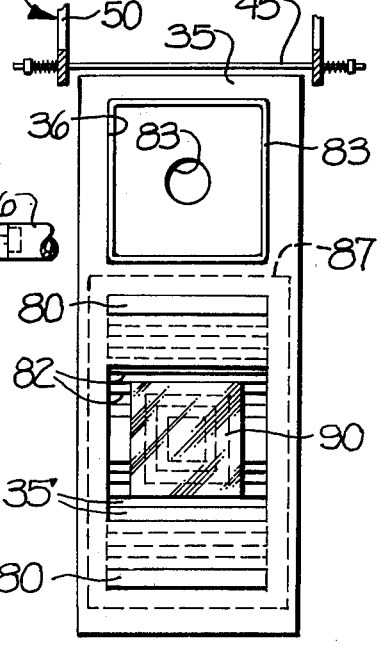
FIG. 16 is a cross-sectional view of the apparatus of FIG. 15 taken generally along the line 16—16 of FIG. 15.
Figure 17:
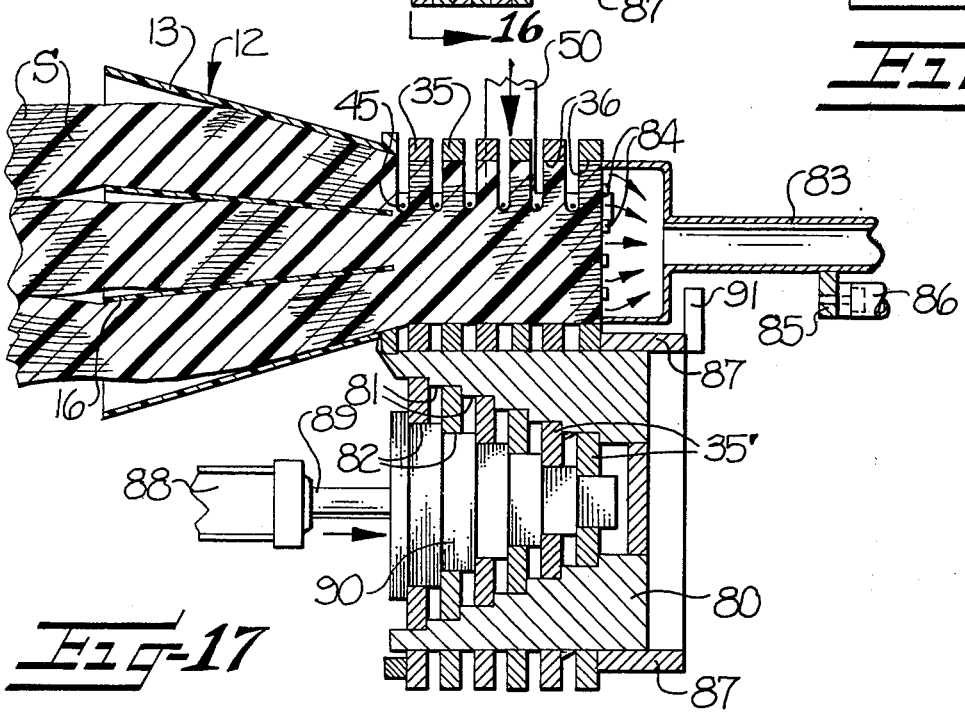
FIG. 17 is a view like FIG. 15 illustrating the devices thereof in the position occupied after loading of the compartment devices with strands from the extruder device.

Referring to FIGS. 15–17, there is shown an alternative arrangement for loading of the compartment devices 35 with the mass of strands S from extruder 12. In this arrangement, the extruder device 12 is mounted stationary and the compartment devices 35 are slidably mounted on a support 80 for movement between the normal spaced-apart slice forming position (See FIG. 17) to side-by-side loading positions (see FIG. 15). In this embodiment, the compartment devices 35 include integral downwardly extending portions 35' extending around and received within stepped cut outs 81 in the support 80. The depending portions 35' of the compartment devices 35 include central cut outs 82 of progressively decreasing size from left to right as viewed in FIGS. 15 and 17. The stepped cut outs 81 in support 80 are so positioned that the compartment devices 35 may slide from right to left as viewed in FIGS. 15 and 17 from the spaced-apart slice forming position to the side-by-side loading position and may slide back to the spaced-apart slice forming positions and be stopped in their respective spaced-apart positions by the stepped cut outs 81 of the support 80 (as viewed in FIG. 17).

In the embodiment of FIGS. 15–17, the holding needles 38 are replaced by a reciprocating vacuum device 83 which is of the same general outside configuration as the interior spaces 36 of the compartment devices 35 for reciprocating movement from the forward end to the rear end or from right to left as viewed in FIGS. 15 and 17 to pass through the interior spaces 36 of the compartment devices 35. The front face of the vacuum device 83 includes slots 84 therein so that, as a vacuum is induced within the vacuum device 83, a pulling or suction action will be produced on the front end of the vacuum device 83. The vacuum device 83 includes a downwardly extending flange 85 which is connected to a suitable piston-cylinder device 86 so that, as fluid is introduced into one end of the piston-cylinder device 86, the vacuum device will be reciprocated from the position shown in FIG. 17 to that shown in FIG. 15. During this reciprocating action, the flange 85 will engage an upstanding flange 91 on a slide collar 87 which is supported by support 80 for engagement with the forwardmost compartment device 35 to move the compartment devices 35 from the slice forming position of FIG. 17 to the loading position of FIG. 15 during forward reciprocating movement of the vacuum device 83 by the piston-cylinder 86.

Thus, as the vacuum device 83 is reciprocated into contact with the fused-fiber front face of the mass of strands S within the extruder 12, the compartment devices 35 will be moved into side-by-side loading position to enhance the suction pulling action of the vacuum device 83 on the fused-fiber front face of the mass of strands S within the extruder 12. As the vacuum device 83 is moved from left to right in its rearward reciprocating movement, the suction on the fused-fiber front face of the mass of strands S in the extruder 12 will cause the mass of strands S to be pulled from the extruder 12 and into the interior areas 36 of the compartment devices 35. The flange 85 is being moved out of engagement with the flange 86 and the compartment devices will be free to be moved back to their spaced-apart slice forming position. For this purpose a piston-cylinder device 88 is provided which includes an extending piston-rod 89 having a stepped outside configurated member 90 on the front end thereof which matches the cut outs 82 in the downwardly depending portions 35' of the compartment devices 35 so that as the member 90 is reciprocated from left to right as shown in FIGS. 15 and 17, it will engage the downwardly depending portion 35' of the compartment devices 35 to slide the compartment devices 35 back to their spaced-apart slice forming positions (as shown in FIG. 17) and the compartment devices will be stopped and positioned by the stepped cut outs 81 in the interior of the support 80. For doffing or removing the slices or tiles T formed by this embodiment of apparatus 10, the extruder 12 may be suitably mounted for pivotal movement away from the compartment devices 35 so that forward reciprocation of the vacuum device 83 will push the previously formed slices or tiles T out of the compartment devices 35.

Figure 18:
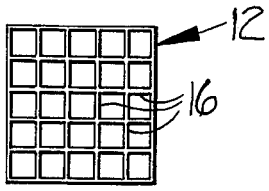
FIG. 18 is a rear elevational view of an extruder device with an arrangement of baffles therein which may be utilized in the slice forming apparatus of this invention.
Figure 19A:
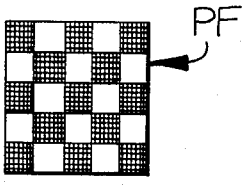
FIGS. 19A, 19B and 19C are plan views of various patterns of non-woven pile fabric that may be formed utilizing the arrangement of baffles in the extruder device of FIG. 18.
Figure 19B:
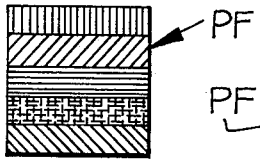
Figure 19C:
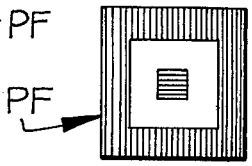

Referring now to FIGS. 18 and 19A–C, it has been discussed above that the extruder 12 may include longitudinally and horizontally extending baffles 16 and a suitable arrangement of such baffles 16 is shown in FIG. 18 and forms a generally checkerboard configuration of individual separate compartments which may receive strands S of different colors or characteristics to form many predetermined patterns, such as those shown in FIGS. 19A, 19B and 19C. As shown in FIG. 19A and as indicated by the cross-hatching therein, stock dyed black strands S may be received in alternate compartments formed by the baffles 16 and stock dyed white strands may be placed in the other compartments to form a pile fabric PF of generally black and white checkerboard pattern. As illustrated in FIG. 19B, rows of stock dyed red strands may be placed in the top row of compartments defined by the baffles 16, brown strands may be placed in the next row, blue strands placed in the next row, yellow strands in the next row and green strands in the bottom row to form a multicolored stripped non-woven pile fabric PF. As shown in FIG. 19C, stock dyed red strands may be placed in all of the outside compartments formed by the baffles 16, stock dyed blue strands may be placed in the centermost compartment and the remaining compartments receive stock dyed white strands for forming the pattern illustrated therein of non-woven pile fabric PF. It may be clear from the above broad explanation that any desired pattern or arrangement of baffles in either a geometric or non-geometric arrangement may be utilized in the extruder 12 for forming predetermined patterned arrangements of strands S of different characteristics or colors.

Figure 20:
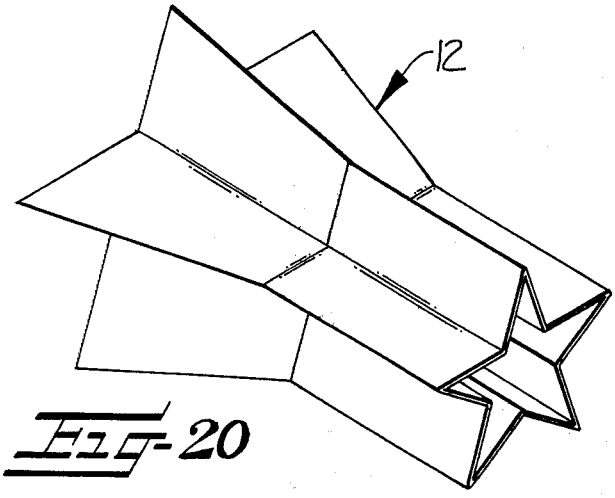
FIG. 20 is a perspective view of an alternate shaped extruder which may be utilized in the slice forming apparatus of this invention.
Figure 21A:
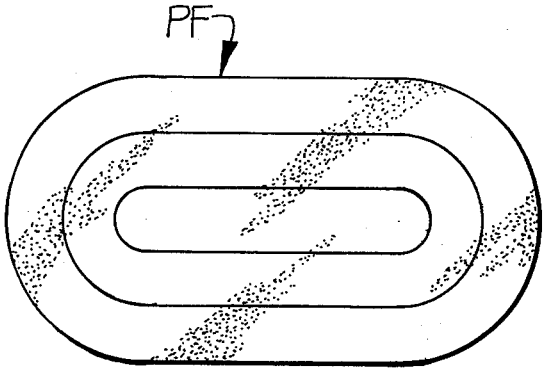
FIGS. 21A, 21B, 21C, 21D and 21E are plan views of various shaped pile fabric slices which may be formed utilizing various shaped extruder devices.
Figure 21B:
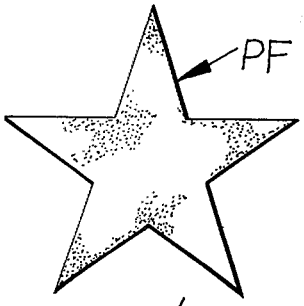
Figure 21C:
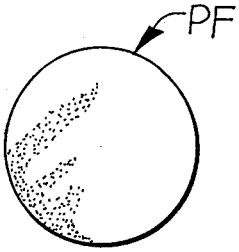
Figure 21D:
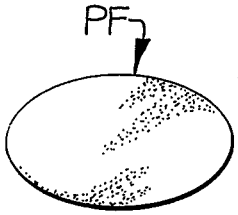
Figure 21E:
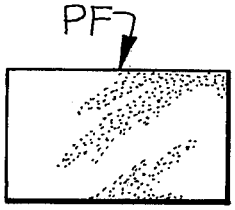

Referring to FIG. 20, there is shown therein an alternate shape for the extruder 12 which is generally in the shape of a star in cross-sectional configuration. With the use of this extruder 12, the compartment devices 35 would also define interior areas 36 of star shaped cross-sectional configuration and the resulting slices or tiles T would be star shaped along with the resulting pile fabric PF, as shown in FIG. 21B. Referring to FIG. 21A, an extruder of generally elliptical shape could be utilized and the baffles therein could be arranged in an elliptical manner so as to form a pile fabric the design illustrated in FIG. 21A. FIGS. 21C, 21D and 21E illustrate other non-square predetermined, geometrical shapes of pile fabric slices PF which could be formed utilizing extruders having those shapes.

Thus, it may be seen that a wide variety of patterns and shapes may be formed with the slice forming apparatus 10 of this invention by arrangement of the baffles 16 and the shape of the extruder 12 along with the interior areas 36 of the compartment devices 35.

Figure 22:
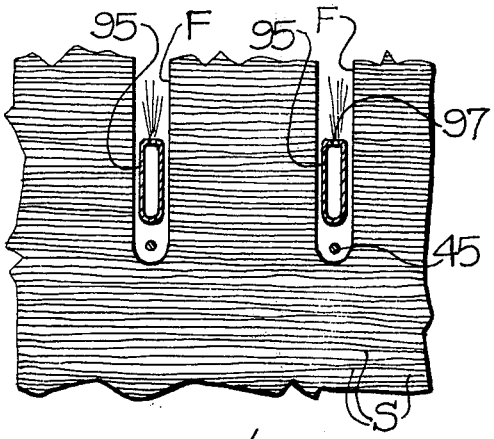
FIG. 22 is a schematic elevational view illustrating an alternate cooling air conduit which may be utilized with each of the hot wire cutting devices.
Figure 23:
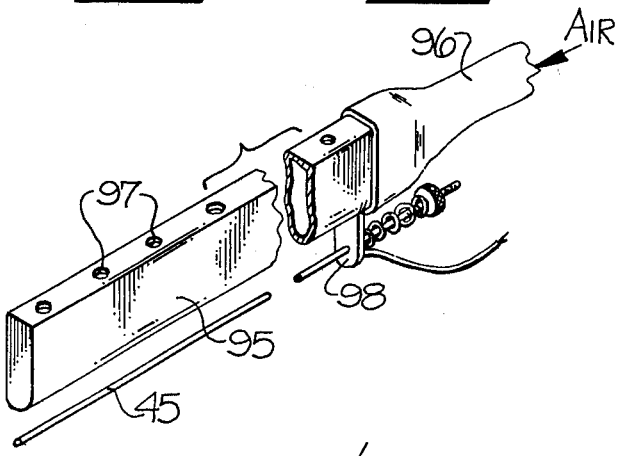
FIG. 23 is a partial perspective view, broken away, of one of the cooling air conduits and hot wire cutting devices illustrated in FIG. 22.

Referring now to FIGS. 22 and 23, there is shown therein a cooling air device 95 which may be suitably mounted for travel with each of the hot wire cutting devices 45 for expelling cooling air immediately behind the hot wire cutting devices 45 on the just cut melted, cut and fused strands S and the fused-fiber faces F to harden the fused fiber faces F immediately and render the slices or tiles T rigid to prevent distortion thereof within the compartment devices 35. The cooling air devices 95 comprise generally separate conduits extending from a flexible air hose 96 which receives pressurized air from any suitable source and supplies the hollow interior of the devices 95 with the pressurized cooling air. Apertures or nozzles 97 are positioned in spaced-apart locations along the top of the devices 95 for expelling cooling air therefrom which contacts the fused-fiber faces of the mass of strands S as the devices 96 are reciprocated with the hot wires 45. The devices 96 may be separately mounted directly onto the hot wires 45 by suitable collars 98 to travel therewith during their reciprocating movement.

While it is generally preferable for the melting, cutting and fusing operation to be performed in a vertical direction from the top to the bottom, this operation may be performed in a horizontal direction with the passageway formed by the compartments 35 extending in a vertical direction, particularly when using the cooling air devices 95 for immediately cooling the fused-fiber faces of the slices or tiles T being formed. The cooling devices 95 will further function to keep the slices or tiles T being formed spaced-apart from each other in this type of operation.

In accordance with this invention, processes for forming a plurality of individual slices or tiles T of textile, pile-forming strands F having interconnected, fused-fiber outer faces F with strand S extending therebetween for subsequent cutting between the fused faces F to form layers of non-woven pile fabric PF are provided. The processes include the steps of receiving and shaping a plurality of parallel textile strands having thermoplastic characteristics into a continuous, longitudinally-extending mass of generally parallel, longitudinally-extending strands of a predetermined transverse cross-sectional configuration; positioning and holding the shaped continuous mass of strands at spaced-apart locations around the circumference thereof to maintain the shaped configuration; and simultaneously transversely melting, cutting and fusing the continuous shaped mass of longitudinally-extending strands on each side of and between the spaced-apart locations at which the mass is being held into a plurality of slices of the shaped predetermined configuration having fused-fiber outer faces with strands extending therebetween for maintaining the integrity of the slices.

Preferably, the step of receiving and shaping the plurality of parallel textile strands into a mass of predetermined configuration includes receiving groups of parallel strands of different characteristics and arranging the strands of different characteristics into a predetermined pattern in the shaped mass of strands. The step of melting, cutting and fusing the continuous shaped mass of strands into a plurality of slices preferably comprises passing a plurality of electrically heated hot wires transversely through the shaped mass of longitudinally-extending strands.

The process may include the step of directing cooling air immediately behind the moving hot wires for cooling the just melted, cut and fused-faces of the slices of strands to prevent distortion of the slices.

The step of receiving and shaping the plurality of parallel textile strands into a continuous longitudinally-extending mass preferably comprises shaping the strands into a generally horizontally-extending mass, and the step of transversely melting, cutting and fusing the continuous mass of strands into a plurality of slices preferably comprises vertically melting, cutting and fusing the mass of strands. However, the step of receiving and shaping may include positioning the mass of strands at an acute angle with respect to the horizontal, and the step of transversely melting, cutting and fusing would be in the vertical direction so as to produce slices having interconnected fused-fiber outer faces with strands extending therebetween at an angle for subsequent cutting between the fused-fiber faces to form layers of non-woven pile fabric with pile strands thereof having a directional lay and extending at an angle.

The above-described process of manufacturing individual slices of textile, pile forming strands may be extended to a process for manufacturing non-woven, textile, pile fabric by adding the step of cutting the slices of strands between the fused faces thereof to form layers of non-woven pile fabric and may include applying a backing material to each of the fused faces prior to the cutting operation.

Some of the combinations and subcombinations of the apparatus and processes of this invention have been specifically set forth above; however, other combinations and subcombinations will become apparent from the description of the invention set forth herein.

In the drawings and specification, there have been set forth preferred embodiments of the process and apparatus of this invention and although specific terms are employed, they are used in a generic and descriptive sense only and not for purposes of limitation.

What is claimed is:

1. In apparatus for manufacturing non-woven, textile, pile fabric from a plurality of pile-forming strands having thermoplastic characteristics; the combination of:

hollow strand extruder means for receiving therein parallel strands extending longitudinally therethrough and for shaping the strands into a continuous mass of a predetermined configuration for withdrawal from said extruder means;

a plurality of relatively thin, spaced-apart, successive, compartment means positioned generally in axial alignment with said extruder means and defining successive, spaced-apart, open-sided, interior areas of the same general configuration as the shaped mass of strands and collectively defining a longitudinally-extending passageway for receiving and holding the continuous mass of strands therein after withdrawal from said extruder means;

means cooperating with said extruder means and said compartment means for moving the continuous shaped mass of strands from said extruder means into said compartment means; and means mounted for progressive movement transversely of the strands through the spaces between and on each side of said compartment means for transversely melting, cutting and fusing the mass of strands in said compartment means into a plurality of individual, transversely-extending slices of the shaped predetermined configuration having interconnected, fused-fiber, outer faces with strands extending therebetween which maintain the integrity of the slices for subsequent cutting between the fused faces to form layers of non-woven pile fabric.

2. In apparatus, as set forth in claim 1, in which said strand moving means comprises means mounting and driving said extruder means for reciprocating movement into and out of said interior areas of said compartment means from a rear end thereof for carrying the continuous shaped mass of strands into said compartment means for loading said compartment means for the next slice forming operation and for pushing the previously formed slices out of said compartment means through a forward end thereof; and means positioned adjacent the forward end of said compartment means for engaging the forward end of the shaped mass of strands within said extruder means when said extruder means reaches the forward end of its reciprocating movement and for holding the continuous shaped mass of strands within said interior areas of said compartment means during the rearward reciprocating movement of said extruder means.

3. In apparatus, as set forth in claim 2, in which said means for engaging and holding the continuous shaped mass of strands within said interior areas of said compartment means during the rearward reciprocating movement of said extruder means comprises a plurality of needle means commonly mounted for reciprocating movement into engagement with and through the continuous mass of strands on the inside of the fused front face thereof formed by the previous slice forming operation for holding the continuous mass of strands during rearward reciprocating movement of said extruder means for loading said compartment means and for reciprocating movement out of engagement with the continuous mass of strands after said extruder means has completed its rearward reciprocating movement.

4. In apparatus, as set forth in claim 1, in which said extruder means is mounted stationary and said strand moving means comprises axiallymovable, reciprocably-mounted vacuum means for movement into and through said interior areas of said compartment means from a front end thereof toward said extruder means on a forward stroke thereof for engaging the fused front face resulting from the last slice forming operation of the mass of strands in said extruder means and withdrawing and pulling the mass of strands into said interior areas of said compartment means during a rearward reciprocating stoke of said vacuum means out of said interior areas of said compartment means for loading said compartment means for the next slice forming operation.

5. In apparatus, as set forth in claim 4, in which said compartment means includes means mounting said compartment means for axial sliding movement between their normal spaced-apart positions to side-by-side positions, and in which said apparatus further includes means for moving said compartment means from their normal spaced-apart positions to the side-by-side positions during the forward reciprocating stroke of said vacuum means for aiding said vacuum means in withdrawing the mass of strands from said extruder means and in loading said compartment means, and means for engaging said compartment means and moving said compartment means from the side-by-side loading positions to the normal slice-forming spaced-apart positions during the rearward loading stroke of said vacuum means.

6. In apparatus, as set forth in claim 1, in which said strand extruder means comprises an elongate, generally funnel-shaped housing having an outwardly tapering rear portion for reception of the strands therein and a forward portion of less cross-sectional dimensions than said rear portion and of a predetermined transverse cross-sectional shape for compressing and shaping the strands as they are received therein from said rear portion.

7. In apparatus, as set forth in claim 6, in which said forward portion of said extruder means comprises a generally square, transverse, cross-sectional configuration.

8. In apparatus, as set forth in claim 6, in which said forward portion of said extruder means comprises a non-square, predetermined, geometrical, transverse, cross-sectional configuration.

9. In apparatus, as set forth in claim 6, in which said rear portion of said funnel-shaped housing of said strand extruder means includes longitudinally and transversely extending baffles therein separating said rear portion into longitudinally-extending compartments for receiving strands which may be of different characteristics in different compartments, said strand receiving baffles being arranged in a predetermined pattern for passing the strands of different characteristics into the forward portion of said funnel-shaped housing of said extruder means for forming a predetermined shaped mass of said strands in the desired predetermined pattern.

10. In apparatus, as set forth in claim 1, in which said means for transversely melting, cutting and fusing the mass of strands into a plurality of individual slices comprises electrically heated wires commonly mounted and driven for progressive movement transversely of the strands through the spaces between and on each side of said compartment means.

11. In apparatus, as set forth in claim 10, in which said apparatus further includes cooling air means mounted for travel with and behind said electrically heated wires during their transverse movement through the mass of strands for cooling the melted cut and fused strands to prevent distortion of the just cut slices within said compartment means.

12. In apparatus, as set forth in claim 1, in which said apparatus further includes holding needle means mounted for reciprocating movement into said interior areas of said compartment means and into holding engagement with the mass of strands therein during operation of said means transversely melting, cutting and fusing the mass of strands into a plurality of slices for holding the strands and preventing distortion thereof during such operation and for reciprocation out of said interior areas of said compartments after the slice forming operation has been completed for removal of the cut and fused slices from said compartment.

13. In apparatus, as set forth in claim 1, in which said compartment means are successively arranged at an acute angle with respect to the horizontal and the passageway defined by said interior areas of said compartment means is disposed generally at an acute angle with respect to the horizontal and define spaces between said compartments extending generally vertically so that said melting, cutting and fusing means will pass vertically through the mass of strands within said compartment means for forming slices having interconnected, fused-fiber, outer faces with strands extending therebetween at an angle for subsequent cutting between the fused-fiber faces to form layers of non-woven pile fabric with the pile strands thereof having a directional lay and extending at an angle.

14. In apparatus for manufacturing non-woven, textile, pile fabric from a plurality of pile-forming strands having thermoplastic characteristics; the combination of:

strand extruder means comprising an elongate, hollow, generally funnel-shaped, horizontally-extending housing having an outwardly tapering rear portion for receiving therein parallel strands which extend longitudinally through said housing and a forward portion of less cross-sectional dimensions than said rear portion and of a predetermined cross-sectional shape for compressing and shaping the strands into a continuous mass of the predetermined configuration for withdrawal from said extruder means;

a plurality of relatively thin, spaced-apart, successive, compartment means positioned generally in axial alignment with said extruder means and defining successive, spaced-apart, open-sided interior areas of the same general configuration as the shaped mass of strands and collectively defining a longitudinally-extending, generally horizontal passageway for receiving and holding the continuous mass of strands therein after withdrawal from said extruder means;

means comprising electrically heated wires, commonly mounted and driven for progressive movement transversely of the strands from the top of to the bottom of and through the spaces between and on each side of said compartment means for transversely melting, cutting and fusing the mass of strands into a plurality of individual, transversely-extending slices of the shaped predetermined configuration having interconnected, fused-fiber, outer faces with strands extending therebetween which maintain the integrity of the slices for subsequent cutting between the fused faces to form layers of non-woven pile fabric;

means mounting and driving said extruder means for reciprocating movement into and out of said interior areas of said compartment means from a rear end thereof for carrying the continuous shaped mass of strands into said compartment means for loading said compartment means for the next slice forming operation and for pushing the previously formed slices out of said compartment means through a forward end thereof; and means positioned adjacent the forward end of said compartment means for engaging the forward end of the shaped mass of strands within said extruder means when said extruder means reaches the forward end of its reciprocating movement and for holding the continuous shaped mass of strands within said interior areas of said compartment means during the rearward reciprocating movement of said extruder means.

15. In apparatus, as set forth in claim 14, in which said means for engaging and holding the continuous shaped mass of strands within said interior areas of said compartment means during the rearward reciprocating movement of said extruder means comprises a plurality of needle means commonly mounted for reciprocating movement into engagement with and through the continuous mass of strands on the inside of the fused front face thereof formed by the previous slice forming operation for holding the continuous mass of strands during rearward reciprocating movement of said extruder means for loading said compartment means and for reciprocating movement out of engagement with the continuous mass of strands after said extruder means has completed its rearward reciprocating movement.

16. In apparatus, as set forth in claim 14, in which said rear portion of said funnel-shaped housing of said strands extruder means includes longitudinally and transversely extending baffles therein separating said rear portion into longitudinally-extending compartments for receiving strands which may be of different characteristics in different compartments, said strand receiving baffles being arranged in a predetermined pattern for passing the strands of different characteristics into the forward portion of said funnel-shaped housing of said extruder means for forming a predetermined shaped mass of said strands in the desired predetermined pattern.

17. In apparatus, as set forth in claim 14, in which said apparatus further includes holding needle means mounted for reciprocating movement into said interior areas of said compartment means and into holding engagement with the mass of strands therein during operation of said means transversely melting, cutting and fusing the mass of strands into a plurality of slices for holding the strands and preventing distortion thereof during such operation and for reciprocation out of said interior areas of said compartments after the slice forming operation has been completed for removal of the cut and fused slices from said compartment.

18. Apparatus for manufacturing non-woven, textile pile fabric from a plurality of pile-forming strands having thermoplastic characteristics; said apparatus comprising;

hollow strand extruder means for receiving therein parallel strands extending longitudinally therethrough and for shaping the strands into a continuous mass of predetermined configuration for withdrawal from said extruder means;

a plurality of relatively thin, spaced-apart, successive, compartment means positioned generally in axial alignment with said extruder means and defining successive, spaced-apart, open-sided, interior areas of the same general configuration as the shaped mass of strands and collectively defining a longitudinally-extending passageway for receiving and holding the continuous mass of strands therein after withdrawal from said extruder means;

means cooperating with said extruder means and said compartment means for moving the continuous shaped mass of strands from said extruder means into said compartment means;

means mounted for progressive movement transversely of the strands through the spaces between and on each side of said compartment means for transversely melting, cutting and fusing the mass of strands in said compartment means into a plurality of individual, transversely-extending slices of the shaped, predetermined configuration having interconnected, fused-fiber, outer faces with strands extending therebetween which maintain the integrity of the slices;

means for receiving the cut and fused slices and for applying a backing material to each of the fused faces thereof; and means for mechanically cutting said slices with the backing material thereon between the fused faces to form layers of non-woven pile fabric.

19. Apparatus for manufacturing non-woven, textile, pile fabric from a plurality of pile-forming strands having thermoplastic characteristics; the combination of:

strand extruder means comprising an elongate, hollow, generally funnel-shaped, horizontally-extending, housing having an outwardly tapering rear portion for receiving therein parallel strands which extend longitudinally through said housing and a forward portion of less cross-sectional dimensions than said rear portion and of a predetermined cross-sectional shape for compressing and shaping the strands into a continuous mass of the predetermined configuration for withdrawal from said extruder means;

a plurality of relatively thin, spaced-apart, successive, compartment means positioned generally in axial alignment with said extruder means and defining successive, spaced-apart, open-sided interior areas of the same general configuration as the shaped mass of strands and collectively defining a longitudinally-extending, generally horizontal passageway for receiving and holding the continuous mass of strands therein after withdrawal from said extruder means;

means comprising electrically heated wires, commonly mounted and driven for progressive movement transversely of the strands from the top of to the bottom of and through the spaces between and on each side of said compartment means for transversely melting, cutting and fusing the mass of strands into a plurality of individual, transversely-extending slices of the shaped predetermined configuration having interconnected, fused-fiber, outer faces with strands extending therebetween which maintain the integrity of the slices;

means mounting and driving said extruder means for reciprocating movement into and out of said interior areas of said compartment means from a rear end thereof for carrying the continuous shaped mass of strands into said compartment means for loading said compartment means for the next slice forming operation and for pushing the previously formed slices out of said compartment means through a forward end thereof;

means positioning adjacent the forward end of said compartment means for engaging the forward end of the shaped mass of strands within said extruder means when said extruder means reaches the forward end of its reciprocating movement and for holding the continuous shaped mass of strands within said interior areas of said compartment means during the rearward reciprocating movement of said extruder means;

means for receiving the cut and fused slices and for applying a backing material to each of the fused faces thereof; and means for mechanically cutting said slices with the backing material thereon between the fused faces to form layers of non-woven pile fabric.

* * * * *